United States Patent [19]

Kurosawa et al.

[11] 4,430,536

[45] Feb. 7, 1984

[54] VACUUM INTERRUPTER

[75] Inventors: Yukio Kurosawa; Akira Wada; Kiyoji Iwashita; Hideaki Tsuda, all of Hitachi, Japan

[73] Assignee: Hitachi, Ltd., Tokyo, Japan

[21] Appl. No.: 389,969

[22] Filed: Jun. 18, 1982

[30] Foreign Application Priority Data

Jun. 24, 1981 [JP] Japan ..... 56-96523

[51] Int. Cl.[3] ..... H01 33/66

[52] U.S. Cl. ..... 200/144 B

[58] Field of Search ..... 200/144 B

[56] References Cited

U.S. PATENT DOCUMENTS 3,935,406 1/1976 Murano et al. ..... 200/144 B 3,946,179 3/1976 Murano et al. ..... 200/144 B

*Primary Examiner*—Robert S. Macon

*Attorney, Agent, or Firm*—Antonelli, Terry & Wands

[57] ABSTRACT

A vacuum interrupter comprises a vacuum vessel, at least a pair of electrical conductor rods extending from interior to exterior of the vacuum vessel, and at least a pair of separable composite electrodes respectively connected to the tip of the electrical conductor rods. Each of the composite electrodes has a main electrode, a parallel magnetic field generator for generating a parallel magnetic field which acts on an arc created when one main electrode is separated fromt the other, and a magnetic field suppressor of high electrical conductivity embedded in a central portion of the main electrode for partly cancelling the parallel magnetic field. In the vacuum interrupter, when the parallel magnetic field permeates through the magnetic field suppressor, eddy current flow is caused therein. A magnetic field due to the eddy current has a polarity opposite to that of the parallel magentic field and partly cancels the parallel magnetic field. Intensity of the parallel magnetic field then becomes smaller at the central portion than that at the other peripheral portion, and the arc tends to shift from the magnetic field suppressor to the outer peripheral portion, thereby preventing fusion damage of the magnetic field suppressor.

6 Claims, 9 Drawing Figures

VACUUM INTERRUPTER

BACKGROUND OF THE INVENTION

This invention relates to a vacuum interrupter comprising a pair of composite electrodes disposed in a vacuum vessel, each having a main electrode and a coil electrode serving as a parallel magnetic field generator which generates a magnetic field in a direction parallel to an arc developing across the main electrodes when the composite electrodes separates from each other.

Generally, the vacuum interrupter has a cylindrical vacuum vessel and a pair of main electrodes which are associated with each other and mounted to respective electrical conductor rods extending from interior to exterior of the vacuum vessel. The paired main electrodes are normally closed for current conduction but in the event of failure occurring in an external circuit, they are opened or separated to protect a loaded electrical apparatus from being damaged. Upon the separation, an arc develops across the paired main electrodes, which is desired to be extinguished as rapidly as possible.

An approach to the extinction of arc is disclosed in, for example, U.S. Pat. No. 3,946,179 (corresponding to U.K. Pat. No. 1,478,702) or U.S. Pat. No. 4,196,327 (corresponding to U.K. Pat. No. 1,573,350), according to which in a vacuum interrupter a magnetic field is applied in parallel to an arc so as to disperse it into innumerable, fine fiber-like segmental arcings. More particularly, the former U.S. patent proposes a pair of composite electrodes each mounted to the tip of an electrical conductor rod and having a main electrode and a coil electrode behind the main electrode. The coil electrode includes a plurality of arm conductors for passing currents in directions which are radial of the central conductor rod, and a plurality of circumferential conductors for changing the radial currents in the arm conductors into looping currents which are concentric with the conductor rod so as to generate parallel magnetic fields of the same polarity in an axial direction of the conductor rod. The paired composite electrodes are superposed or mated so that magnetic fields due to radial currents, coming into and out of the central conductor rod, are cancelled. More specifically, radial currents in one composite electrode have the same magnitude as but opposite direction to those of radial currents in the other composite electrode and hence magnetic fields generated at the arm conductors of the paired composite electrodes are cancelled. Consequently, the generation of magnetic fields by the coil electrodes is due to looping currents in the circumferential conductors which flow in the same circumferential direction in the paired composite electrodes. The parallel magnetic fields generated by the coil electrodes of the respective composite electrodes, having the same polarity and being applied in the axial direction, are concentrated to a central portion of the main electrode and conductor rod of the respective composite electrodes. Accordingly, magnetic flux density is high at the central portion and decreases toward the circumferential portion. With this construction, when the main electrodes are separated in response to a peak value of an accident current, a highly intensive parallel magnetic field will act on an arc. For example, when the accident current is 63 KA, the magnetic flux density at the central portion amounts up to 1000 T. Under the application of such a highly intensive magnetic field, however, the arc, which would be spread rapidly from the central to circumferential portions of the main electrode under the application of a suitably intensive parallel magnetic field, cannot any more spread to the circumferential portion but undergoes degeneracy at the central portion. As a result, the central portion will be fused terribly, giving rise to failure of interruption and consequent impairment of interruption performance.

SUMMARY OF THE INVENTION

An object of this invention is to provide a vacuum interrupter capable of minimizing fusion damage at the central portion on a major surface of the main electrode due to the parallel magnetic field, thereby improving interruption performance.

According to this invention, a vacuum interrupter has a composite electrode having a main electrode which is provided, at a central portion on its major surface, with a magnetic field suppressing member of high electrical conductivity which projects from the major surface. When a parallel magnetic field permeates through the magnetic field suppressing member, eddy current generated in the magnetic field suppressing member creates a magnetic field which partly cancels the parallel magnetic field so that an arc developing at the magnetic field suppressing member can be shifted to that portion on the main surface which is exterior of the magnetic field suppressing member, where the parallel magnetic field is now more intensive than that at the magnetic field suppressing member, thereby minimizing fusion damage of the magnetic field suppressing member and improving interruption performance.

DESCRIPTION OF THE PREFERRED EMBODIMENTS

Figure 1:
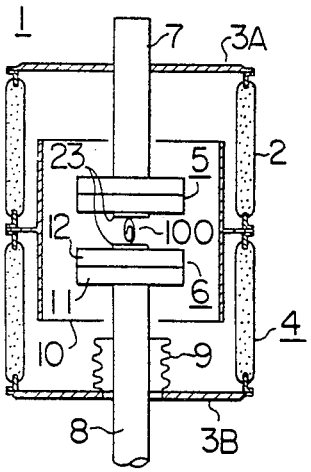
FIG. 1 is a sectional view of a vacuum interrupter according to an embodiment of the invention.

Referring to FIG. 1, a vacuum interrupter 1 comprises a vacuum vessel 4 constituted by an insulating cylinder 2 and end plates 3A and 3B secured to opposite ends of the cylinder 2 for airtight sealing of interior of the vacuum vessel. A pair of composite electrodes, associated stationary and movable composite electrodes 5 and 6, are separably supported in the vacuum vessel by electrical conductor rods 7 and 8 secured to the back of the respective composite electrodes and extending exteriorly of the vacuum vessel. A metal bellows 9 bridging one of the conductor rods 8 and the end plate 3B is provided in a form of facilitating movement of the rod 8 for separation of the movable composite electrode 6 from the stationary composite electrode 5. An intermediate shield 10 supported between both the composite electrodes and the inner wall of the insulating cylinder serves to prevent metallic vapor caused by arc created upon the separation from being deposited on the inner wall. Because of similarity in the construction of both the composite electrodes, only the movable composite electrode 6 will be described in greater detail with reference to FIG. 2.

The movable composite electrode 6 comprises a coil electrode 11 close to the bellows and a main electrode 12. The coil electrode 11 has a central portion O connected, at one surface, to an end of the electrical conductor rod 8, and four arm conductors 13 extending from the central portion in radial directions and terminating in circumferential conductors 14 directed in the same circumferential direction. Each of the circumferential conductors 14 has, at its free end, a connecting conductor 15 projecting toward the main electrode, and the connecting conductor 15 is spaced apart from an adjacent arm conductor 13 through a gap 16. The connecting conductors 15 couple to respective connecting conductors 17 formed on the back of the main electrode. A spacer 18 (FIG. 3B) interposed between the central portion 0 and the back of the main electrode prevents short-circuit current flow between the central portion 0 and the main electrode 12. Accordingly, current I from the rod 8 branches, by an amount of $\frac{1}{4}$ I, to each arm conductor 13 and circumferential conductor 14, and passes through the connecting conductors 15 and 17, thus reaching the main electrode 12.

Figure 2:
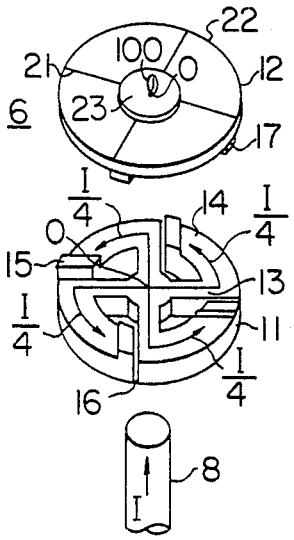
FIG. 2 illustrates, in exploded perspective form, a movable composite electrode shown in FIG. 1.

The main electrode 12 is made of a material of relatively low electrical conductivity such as Cu-Cr alloy, Cu-Co alloy, Cu-Fe alloy or Cu-Ni alloy of 20 to 40% electrical conductivity pursuant to IACS (International Annealed Copper Standard) with the aim of reducing eddy current. The main electrode is partly cut away to provide four slits 21 which are effective to reduce eddy current. The main electrode has, at a central portion 0 on major surface 22, a magnetic field suppressing member 23 embedded in the main electrode and projecting toward an opposing main electrode of the associated composite electrode, as shown in FIGS. 1, 2 and 3B. The magnetic field suppressing member 23 is made of a material of high electrical conductivity such as pure copper, for example. The magnetic field suppressing member 23 is made integral with the main electrode by brazing with silver solder.

The magnetic field suppressing member 23 operates as follows.

Figure 3A:
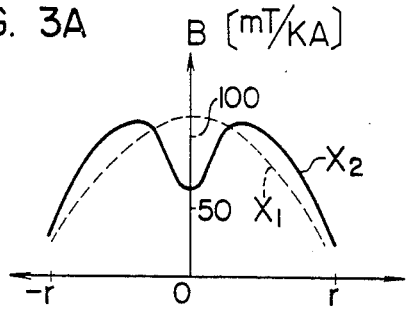
FIG. 3A is a graph showing a parallel magnetic field distribution characteristic.
Figure 3B:
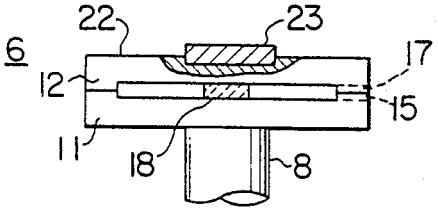
FIG. 3B illustrates, partly in section, a side view of the movable composite electrode of FIG. 2.

Generally, when accident current I flows through the conductor rod 8 and coil electrode 11, currents of $\frac{1}{4}$ I in circumferential conductors 14 generate parallel magnetic fields which are concentrated to the central portion 0 of the main electrode 12, thus providing a parallel magnetic field distribution characteristic $X_1$ as shown at dotted curve in FIG. 3A wherein the magnetic field is highly intensive at the central portion 0 and decreases gradually toward r and −r respectively indicative of righthand and lefthand peripheral edges. In FIG. 3A, ordinate represents intensity of magnetic field B (mT/KA).

In the vacuum interrupter according to the invention, an arc 100 created across the opposing main electrodes 12 when the movable composite electrode 6 separates from the stationary composite electrode 5 first ignites the raised magnetic field suppressing member 23. Then, the parallel magnetic field generated by the coil electrode 11 permeates through the magnetic field suppressing member and eddy current flow is caused therein. A magnetic field due to the eddy current has an opposite polarity to that of the parallel magnetic field and cancels part of the parallel magnetic field. As a result, the magnetic flux density at the magnetic field suppressing member 23 is decreased, and hence the parallel magnetic field becomes more intensive at that portion on the major surface which is exterior of the magnetic field suppressing member, than that at the magnetic field suppressing member, thus providing a parallel magnetic field distribution characteristic as shown at solid curve $X_2$ in FIG. 3A. Consequently, the arc developing at the magnetic field suppressing member 23 spreads from the magnetic field suppressing member to the outer portion on the major surface 22 as if it were sucked by the major surface 22. Since the major surface occupies a far larger area for the highly intensive parallel magnetic field than for the magnetic field suppressing member, plasma density in the arc can be reduced to prevent fusion damage of the magneic field suppressing member. This improves interruption performance greatly. For example, experiments conducted by inventors of this invention showed that with a pair of composite electrodes of 136 mm diameter, greatly improved performance can be obtained wherein a fairly large current of 88 KA (65 KA) can be interrupted at 7.2 KV. Parenthesized data are for interruption performance obtained conventionally.

The magnetic field suppressing member 23 is preferably made of a material of high electrical conductivity with the view of reducing delay in phase of the magnetic field created by eddy current. If a material of low electrical conductivity or large electrical resistance is used for the magnetic field suppressing member 23, delay in phase of eddy current becomes large with the result that the magnetic field due to the eddy current becomes out of phase with respect to the parallel magnetic field and its cancellation effect is degraded, leading to stagnation of the arc at the magnetic field suppressing member and consequent fusion damage thereof. The magnetic field suppressing member made of a material of high electrical conductivity is also advantageous in that heat generation by current can be suppressed and generated heat can readily be dissipated. Preferably, the material of high electrical conductivity may be pure copper, for example, oxygen free copper, or Pb-Cu alloy.

Figure 4A:
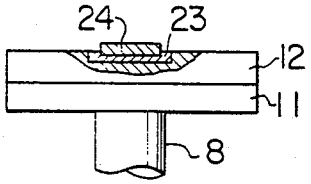
FIGS. 4A, 4B and 4C illustrate, in partly section, movable composite electrodes with modified main electrodes according to other embodiments of the invention.
Figure 4B:
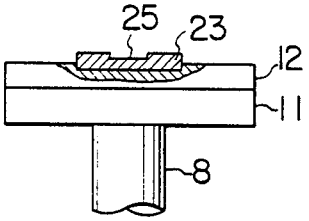
Figure 4C:
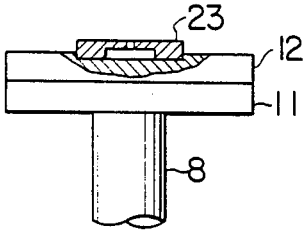

Referring to FIGS. 4A to 4C, there are shown modified main electrodes according to other embodiments of the invention.

A main electrode shown in FIG. 4A comprises a contact member 24 provided on the magnetic field suppressing member 23. In this modification, it is not always necessary that material of the magnetic field suppressing member 23 be pure copper but the member 23 may be made of a material having an electrical conductivity approximating that of pure copper. In another modification as shown in FIG. 4B, a magnetic field suppressing member 23 is formed with a central recess 25. In still another modification as shown in FIG. 4C, a magnetic field suppressing member 23 is formed in a cup-like shape and plays a part of a contact member.

Figure 5:
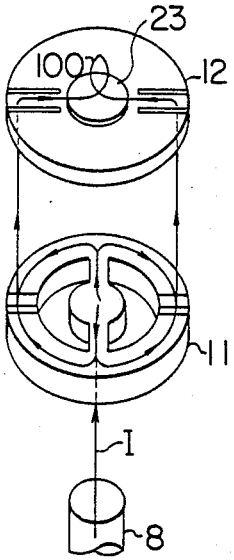
FIG. 5 illustrates, in exploded perspective form, a modified movable composite electrode according to another embodiment of the invention.
Figure 6:
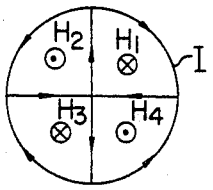
FIG. 6 is a diagram showing current paths in the composite electrode of FIG. 5.

Referring to the embodiment of FIG. 5, in a composite electrode as disclosed in the aforementioned U.S. Pat. No. 4,196,327 (U.K. Pat. No. 1,573,350) wherein a coil electrode 11 and a main electrode 12 establish a current path shown by arrows so that four-pole parallel magnetic fields $H_1$ to $H_4$ as shown in FIG. 6 are applied to an interruption arc, there is provided the magnetic field suppressing member 23 playing the part of a contact member.

In this type of composite electrode, the parallel magnetic field becomes basically null at the central portion of the main electrode 12. But manufacture tolerance will allow the presence of a slight parallel magnetic field at the central portion. Even in such a case, the magnetic field suppressing member 23 reduces the parallel magnetic field as shown in FIG. 3A so as to shift an arc from the magnetic field suppressing member 23 to the peripheral edges, thereby preventing fusion damage of the magnetic field suppressing member 23.

While in the foregoing embodiments, the coil electrode was supported in the vacuum vessel, similar operation and effect may obviously be attained by a coil electrode formed by winding a coil exteriorly of the vacuum vessel.

As has been described, according to the present invention, when the parallel magnetic field permeates through the magnetic field suppressing member of high electrical conductivity provided for the central portion of the main electrode, magnetic field due to eddy current flow in the magnetic field suppressing member reduces the parallel magnetic field so as to shift arc created at the magnetic field suppressing member from this member to that portion on the major surface of the main electrode which is exterior of the magnetic field suppressing member, thereby making it possible to prevent fusion damage of the magnetic field suppressing member. Accordingly, the vacuum interrupter of this invention can improve interruption performance greatly.

What is claimed is:

1. A vacuum interrupter comprising:

a vacuum vessel;

at least a pair of electrical conductor rods extending from interior to exterior of said vacuum vessel; and a pair of separable composite electrodes respectively connected to said electrical conductor rods within said vacuum vessel, each of said composite electrodes having a main electrode and parallel magnetic field generator means for generating a magnetic field substantially parallel to an arc developing between the main electrodes when one main electrode is separated from the other in response to movement of one of said electrical conductor rods so as to extinguish the arc, in which each of said main electrodes has, at a central portion on its major surface, magnetic field suppressing means which projects toward the opposing main electrode to cancel partly the parallel magnetic field near the central portion.

2. A vacuum interrupter according to claim 1 wherein said magnetic field suppressing means is made of a material of high electrical conductivity such as pure copper or Pb-Cu alloy.

3. A vacuum interrupter according to claim 1, wherein said magnetic field suppressing means is made of oxygen free copper.

4. A vacuum interrupter comprising:

a vacuum vessel;

at least a pair of electrical conductor rods extending from interior to exterior of said vacuum vessel; and a pair of separable composite electrodes respectively connected to said electrical conductor rods within said vacuum vessel, each of said composite electrodes having a main electrode and parallel magnetic field generator means for generating a magnetic field substantially parallel to an arc developing between the main electrodes when one main electrode is separated from the other in response to movement of one of said electrical conductor rods so as to extinguish the arc, each of said main electrodes having, at a central portion on its major surface, contact means projecting toward the opposing main electrode and magnetic field suppressing surrounding said contact means to partly cancel the parallel magnetic field.

5. A vacuum interrupter according to claim 4 wherein said magnetic field suppressing means is made of a material of high electrical conductivity such as pure copper or Pb-Cu alloy.

6. A vacuum interrupter according to claim 4 wherein said magnetic field suppressing means is made of oxygen free copper.

* * * * *